US006024858A

United States Patent [19]

Nishino et al.

[11] Patent Number: 6,024,858

[45] Date of Patent: Feb. 15, 2000

[54] METHOD OF PRODUCING AN ALUMINUM SUPPORT FOR A PLANOGRAPHIC PLATE

[75] Inventors: Atsuo Nishino; Akio Uesugi, both of Shizuoka, Japan

[73] Assignee: Fuji Photo Film Co., Ltd., Kanagawa, Japan

[21] Appl. No.: 08/925,071

[22] Filed: Sep. 8, 1997

Related U.S. Application Data

[63] Continuation of application No. 08/521,578, Aug. 30, 1995, abandoned.

[30] Foreign Application Priority Data

Aug. 30, 1994 [JP] Japan ..... 6-205657

[51] Int. Cl.[7] ..... B41N 3/03

[52] U.S. Cl. ..... 205/139; 205/153; 205/214; 205/640; 205/921

[58] Field of Search ..... 205/139, 153, 205/214, 921, 640, 658, 659, 674

[56] References Cited

U.S. PATENT DOCUMENTS

| | | | |
|---|---|---|---|
| 3,079,308 | 2/1963 | Ramirez et al. | 204/139 |
| 3,827,951 | 8/1974 | Kallianides | 205/138 |
| 4,545,866 | 10/1985 | Ohba et al. | 205/50 |
| 4,902,389 | 2/1990 | Nishino et al. | 205/651 |
| 5,518,589 | 5/1996 | Matsuura et al. | 205/659 |

FOREIGN PATENT DOCUMENTS

| | | |
|---|---|---|
| 0291760 | 11/1988 | European Pat. Off. . |
| 0317866 | 5/1989 | European Pat. Off. . |
| 0422682 | 4/1991 | European Pat. Off. . |
| 0645260 | 3/1995 | European Pat. Off. . |
| 3828291 | 3/1989 | Germany . |
| 2019022 | 10/1979 | United Kingdom . |
| 2047274 | 11/1980 | United Kingdom . |

OTHER PUBLICATIONS

Patent Abstracts of Japan, Abs. Grp. No. C673. vol. 14, No. 7, abstracting 01–252800, Jan. 1989.

*Primary Examiner*—Kathryn Gorgos
*Assistant Examiner*—William T. Leader
*Attorney, Agent, or Firm*—Sughrue, Mion, Zinn, Macpeak & Seas, PLLC

[57] ABSTRACT

An aluminum support for a planographic printing plate is produced by (1) etching a surface of an aluminum plate chemically in an acidic or alkaline aqueous solution, (2) roughening the surface of the aluminum plate electrochemically in an acidic aqueous solution by applying DC voltage to form honeycomb pits having an average diameter from 0.5 to 10 $\mu$m and to leave plateau portions, (3) etching the surface of the aluminum plate to render the plateau portions less than 10% of the surface, (4) roughening the surface of the aluminum plate electrochemically in an acidic aqueous solution using direct current or alternating current to form honeycomb pits having an average diameter from 0.1 to 2 $\mu$m, (5) etching the surface of the aluminum plate chemically, and (6) anodizing the surface of the aluminum plate in an acidic solution. A low current density starting zone, or soft starting zone, may be provided at a first roughening stage. At least one electrode in the soft starting zone is connected to a first electric power supply for electrolysis at 100 A/dm$^2$ or less, which is lower than the current density used in any subsequent main roughening step. Main roughening is carried out using at least one additional electrode connected to a separate main electric power supply. An aluminum support for a planographic printing plate excellent in fill-in reduction of ink and scumming reduction is obtained.

4 Claims, 6 Drawing Sheets

METHOD OF PRODUCING AN ALUMINUM SUPPORT FOR A PLANOGRAPHIC PLATE

This is a Continuation of application Ser. No. 08/521,578 filed Aug. 30, 1995, now abandoned.

BACKGROUND OF THE INVENTION

This invention relates to an aluminum support for a planographic printing plate, its production and roughening an aluminum support, suitable for offset printing, etc.

In general, aluminum plates are widely used as supports for a planographic printing plate. The surface of the aluminum plate is usually roughened for the purpose of the improvement in adhesiveness of a photosensitive layer provided thereon and the improvement in the water retention of nonimage area (the area which receives damping water used during printing and repels oily ink, and is carried by the area wherein the surface of the support is exposed) of the planographic printing plate produced using the same.

The roughening is called graining and requires a great deal of skill. The graining can be divided roughly into mechanical methods, such as ball graining, wire graining and brush graining, and electrochemical methods.

In the case of ball graining, there are many factors requiring skill, such as ball material, the type of abrasive and control of water amount during graining, and moreover, graining of plates must be conducted one by one because continuous graining is impossible. In the case of wire graining, grained surface is not uniform. On the other hand, brush graining brings uniformly grained surface, and continuous graining is possible. Accordingly, brush graining is suitable for mass production.

In any event, it is difficult to obtain a plate having sufficient performance for a support for a printing plate by the mechanical method mentioned above.

In general, it is said that the greater surface roughness brings the greater water retention, and in the case of producing a planographic printing plate, preferred supports have indentations as uniform as possible in order to improve water retention and printability. As a means for producing such a preferable surface, electrochemical roughening is noted. In the case of electrochemical roughening, aluminum plates having a uniformly roughened surface can be obtained by keeping various conditions, such as the composition and temperature of electrolytic solution, electrolytic conditions, etc.

The electrochemical roughening can be divided roughly into methods of using alternating current and methods of using direct current. The method of using alternating current has a disadvantage that unevenness tends to occur in the direction perpendicular to the advancing direction of an aluminum plate according to the frequency of the alternating current used for roughening and traveling speed of the aluminum plate.

A means for solving the above problem is disclosed in U.S. Pat No. 4,902,389 wherein anodes and cathodes are arranged alternately faced to an aluminum plate. DC voltage is applied between both electrodes, and an aluminum plate is passed with keeping a prescribed space.

However, according to the roughening using direct current only, scumming reduction is incompatible with fill-in reduction of ink at half-tone dot portions upon reducing damping water, and printability applicable to high grade printing cannot be achieved. In the roughening disclosed in U.S. Pat. No. 4,902,389 using direct current, roughening greatly depends on an apparatus, and in order to produce a surface shape suitable for the printability of the aluminum support for various planographic printing plates, electrolytic conditions must be greatly changed.

SUMMARY OF THE INVENTION

An object of the invention is to provide an aluminum support for a planographic printing plate excellent in fill-in reduction of ink and scumming reduction.

Another object of the invention is to provide a method of producing an aluminum support for a planographic printing plate excellent in fill-in reduction of ink and scumming reduction.

Another object of the invention is to provide a method of roughening an aluminum support capable of producing a surface shape preferable for a support for a printing plate.

The above object has been achieved by an an aluminum support for a planographic printing plate of which a surface is provided with honeycomb pits having an average diameter from 0.1 to 2 $\mu$m formed by overlapping indentations with an average pitch from 1 to 80 $\mu$m, and the surface having a mean surface roughness from 0.3 to 1.5 $\mu$m, an aluminum support for a planographic printing plate of which a surface is provided with honeycomb pits having an average diameter from 0.5 to 10 $\mu$m, and the surface having a mean surface roughness from 0.3 to 1.0 $\mu$m, and a method of producing the same.

Figure 1:
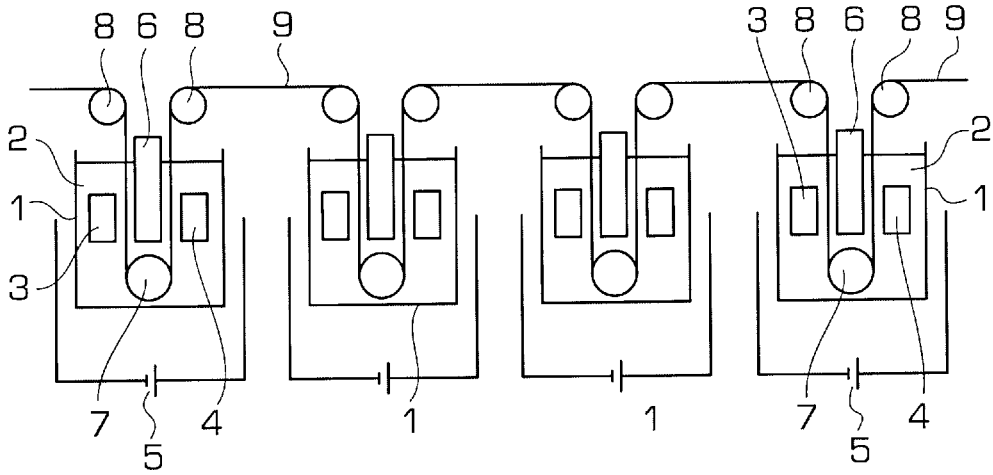
FIGS. 1 and 2 are schematic diagrams illustrating apparatuses used for roughening by direct current in the method of producing an aluminum support for a planographic printing plate of the invention.

1, 11, 77, 78, 111, 121 . . . Electrolytic bath 2, 12 . . . Acidic aqueous solution 3, 13, 41, 51, 61, 71, 81, 105 . . . Cathode 4, 14, 42 52, 62, 72 . . . Anode 5, 65, 79, 180 . . . DC source 20 6 . . . Partition wall 9, 18, 28 . . . Aluminum plate 25 . . . AC source 63, 64, 73, 87, 90, 91, 92, 93, 107 . . . Cathode for soft starting 25 76, 83, 103 . . . Anode for soft starting 108, 131, 132, 133 . . . DC source for soft starting

DETAILED DESCRIPTION OF THE INVENTION

In a first aspect of the aluminum support for a planographic printing plate of the invention, a surface is provided with honeycomb pits having an average diameter from 0.1 to 2 μm formed by overlapping indentations with an average pitch of 1 to 80 μm, and the surface having a mean surface roughness from 0.3 to 1.5 μm.

When the average pitch is less than 1 μm, printing durability and water retention are degraded. When the average pitch is more than 80 μm, scumming reduction is degraded. A preferable average pitch is from 20 to 50 μm. When the average diameter of honeycomb pits is less than 0.1 μm, removal of ink at start of printing is degraded. When the average diameter of honeycomb pits is more than 2 μm, scumming reduction is degraded. A preferable average diameter is from 0.5 to 1.5 μm. A preferable density of honeycomb pits is from 100,000 to 100,000,000 pits/mm$^2$, more preferably from 1,000,000 to 80,000,000 pits/mm$^2$, most preferably from 25,000,000 to 80,000,000 pits/mm$^2$. When the mean surface rougheness is less than 0.3 μm, ink is liable to cling to half-tone dot portions upon reducing damping water. When the mean surface roughness is more than 1.5 μm, scumming reduction is degraded. A preferable mean surface roughness is from 0.4 to 1.0 μm.

In a second aspect of the aluminum support for a planographic printing plate of the invention, a surface is provided with honeycomb pits having an average diameter from 0.5 to 10 μm, and the surface having a mean surface roughness of 0.3 to 1.0 μm.

When the average diameter of honeycomb pits is less than 0.5 μm, printing durability degrades. When the average diameter of honeycomb pits is from more than 10 μm, scumming reduction is degraded. A preferable average diameter of honeycomb pits is 2 to 7 μm. When the mean surface roughness is less than 0.3 μm, ink is liable to cling to half-tone dot portions upon reducing damping water. When the mean surface roughness is more than 1.0 μm, scumming reduction is degraded.

A first aspect of the method of producing an aluminum support for a planographic printing plate of the invention (Production I) comprises, (1) etching a surface of an aluminum plate chemically in an acidic or alkaline aqueous solution (first chemical etching), (2) roughening the surface of the aluminum plate electrochemically in an acidic aqueous solution by applying DC voltage to form honeycomb pits having an average diameter from 0.5 to 10 μm with a density from 10,000 to 100,000 pits/mm$^2$ and to leave plateau portions without honeycomb pits or with honey comb pits having an average diameter of less than 0.5 μm at a rate from 15 to 60% of the surface (first direct current roughening), (3) etching the surface of the aluminum plate chemically in an acidic or alkaline aqueous solution to render the plateau portions less than 10% of the surface (second chemical etching), (4) roughening the surface of the aluminum plate electrochemically in an acidic aqueous solution using direct current or alternating current to form honeycomb pits having an average diameter from 0.1 to 2 μm (second direct current (or alternating current) roughening), (5) etching the surface of the aluminum plate chemically in an acidic or alkaline aqueous solution (third chemical etching), and (6) anodizing or anodizing and rendering hydrophilic the surface of the aluminum plate in an acidic aqueous solution The first chemical etching is conducted as a pretreatment of the first direct current roughening for the purpose of removing rolling oil, smuts, naturally formed oxide layer, etc. As the acid used for the acidic aqueous solution, there are fluoric acid, fluorozirconic acid, phosphoric acid, sulfuric acid, hydrochloric acid, nitric acid, etc., and mixtures thereof, as disclosed in Japanese Patent KOKAI 57-16918. As the alkali used for the alkaline aqueous solution, there are sodium hydroxide, potassium hydroxide, trisodium phosphate, sodium aluminate, sodium silicate, sodium carbonate, etc., and mixtures thereof, as disclosed in Japanese Patent KOKAI 57-16918. A suitable acid concentration of the acidic aqueous solution is from 0. 5 to 25 wt. %, preferably from 1 to 5 wt. %. The aluminum content dissolved in the acidic aqueous solution is from preferably 0.5 to 5 wt. %. A suitable alkali concentration of the alkaline aqueous solution is from 5 to 30 wt. %, preferably from 20 to 30 wt. %. The aluminum content dissolved in the alkaline aqueous solution is preferably from 0.5 to 30 wt. A suitable etching amount is from 1 to 10 g/m$^2$, preferably from 1.5 to 5 g/m$^2$.

The chemical etching may be combined with a mechanical roughening, an electrochemical roughening in an aqueous, solution containing nitric acid as a principal component by using alternating current, an electrochemical roughening in an aqueous solution containing hydrochloric acid as a principal component, an electrochemical roughening in a neutral salt aqueous solution or an electrochemical etching in a neutral salt aqueous solution, etc.

The first direct current roughening is conducted by putting the acidic aqueous solution in an electrolytic bath, arranging anodes and cathodes alternatingly in the acidic aqueous solution, applying DC voltage, and passing the aluminum plate with keeping a prescribed distance from the anodes and the cathodes.

The acidic aqueous solution may be usual ones for electrochemical roughening using alternating current, and includes aqueous solutions containing hydrochloric acid or nitric acid as a principal component. Aqueous solutions containing nitric acid as a principal component are preferred. Various nitric acid compounds containing nitrate ion, such as aluminum nitrate, sodium nitrate or ammonium nitrate can be used for the aqueous solution containing nitric acid as a principal component. It is preferable to add at least one aluminum salt or ammonium salt in an amount from 1 to 150 g/l. Ammonium ions naturally increase during electrolyzing in a nitric acid aqueous solution. Moreover, various metals contained in aluminum alloys, such as iron, copper, manganese, nickel, titanium, magnesium, silicon, may be dissolved in the acidic aqueous solution. Ammonium ions, nitrate ions, etc. may also be added. A suitable acid concentration of the acidic aqueous solution is 1 g/l to saturation, preferably from 5 to 100 g/l. When the acid concentration is less than 1 g/l, electrical conductivity is inferior to elevate electrolytic voltage. When the acid concentration is too high, corrosion of apparatuses is a problem. A suitable temperature of acidic aqueous solution is from 30 to 55° C., preferably from 40 to 50° C. When the temperature is lower than 30° C. electrical conductivity is inferior to elevate electrolytic voltage. When the temperature is higher than 55° C., corrosion of apparatuses is a problem.

In the first direct current roughening, anodes and cathodes are composed of one member or an aasembly of plural electrode pieces. The assembled electrode is preferable because of easy making, inexpensiveness and uniform electric current distribution. In the case of the assembled electrode, a plurality of electrode pieces are arranged in parallel at prescribed intervals, arranged in parallel intervening insulating materials 1 to 5 mm in thickness. The shape of the electrode piece is not limited, and may be a column, a prism, a plate or the like. Preferable insulating materials have both an electrical insulating ability and a chemical resistance, such as vinyl chloride resins, rubbers, fluoro resins such as polytetrafluoroethylene, FRP, etc. It is preferable to arrange at least three couples of an anode and a cathode alternately, and to arrange 3 to 15 couples is particularly preferred. A preferable length L(m) of the anode row (or cathode row) is 0.05 to 3 V(m) wherein V is the traveling distance (m) per one second of the aluminum plate to be roughened.

The anode may be an electrode wherein a valve metal, such as titanium, tantalium and niobium is plated or cladded with a platinum group metal such as platinum, a ferrite electrode or the like. The ferrite electrode is difficult to be formed into a long electrode, and accordingly, it is made by assembling two or more electrodes contacted by each other or by superimposing the electrodes. Since the connected portions causes uneven roughening, it is preferable to arrange the electrodes staggering in the advancing direction of the aluminum plate.

The cathode may be made of platinum, stainless steel, carbon, titanium, tantalum, niobium, zirconium, hafnium, alloys thereof, etc. In the case of using titanium, it is preferable to coat the surface by a platinum group metal and then to heat-treat between 400° C. and 1,000° C. for 30 to 60 minutes.

As referred to in this specification, the direct current voltage includes not only continuous direct current voltage but also commercial alternating current rectified by diode, transistor, thyristor, GTO or the like, rectangular pulse direct current, and is an electric voltage wherein polarity is not changed which meets general definition of direct current, and continuous direct current having a ripple factor of 10% or less is preferred.

A preferable current density from 20 to 200 A/dm$^2$, and 50 to 120 A/dm$^2$ is more preferable. A preferable quantiy of electricity charged on the aluminum plate in the first direct current roughening is from 200 to 1,000 C/dm$^2$, particularly preferably from 250 to 600 C/dm$^2$.

The second chemical etching is conducted for the purpose of dissolving edges of honeycomb pits formed in the first direct current roughening and of removing the plateau portions not forming honeycomb pits or forming only honeycomb pits having an average diameter of less than 0.5 $\mu$m and of removing smut components mainly composed of aluminum hydroxide. If smut components remain, the subsequent second direct current (or alternating current) roughening becomes uneven. If the plateau portions remain at more than 10% of the surface, the printing plate made of the aluminum support is inferior in brush scumming reduction and scumming reduction. The area of the plateau portions is not more than 10%, and preferably not more than 5%. Accordingly, the remaining plateau portions are rendered not more than 10%, preferably not more than 5% in this process. The acidic aqueous solution and alkaline aqueous solution used in this process may be those as mentioned in the process of the first chemical etching. A suitable etching amount is from 0.1 to 20 g/m$^2$, preferably from 3 to 15 g/m$^2$. Suitable conditions for etching from 0.1 to 20 g/m$^2$ of aluminum plate are, using from 0.05 to 40% acidic or alkaline aqueous solution, and etching between 40 and 100° C. of the solution temperature, from 2 to 300 seconds. In the case of etching using an alkaline aqueous solution, insoluble matters, i.e. smuts, are formed on the surface of the aluminum plate, it is preferable to wash the surface with a solution of phosphoric acid, sulfuric acid, nitric acid, chromic acid or a mixture thereof. In the case of using an acidic aqueous solution, the above washing can be omitted because of rare formation of smuts.

In the second direct current or alternating current roughening, honeycomb pits having an average diameter from 0.1 to 0.4 $\mu$m or from 0.5 to 2 $\mu$m are overlapped with or superimposed on the pits previously formed, and scumming reduction (the ability of not adhering ink onto the nonimage area) and printing durability are improved.

In the case of forming honeycomb pits having an average diameter from 0.1 to 0.4 $\mu$m in the second direct current or alternating current roughening, the aluminum plate is roughened electrochemically in an aqueous solution containing nitric acid as a principal component using direct current (direct current roughening), or roughened electrochemically in an aqueous solution containing hydrochloric acid as a principal component using alternating current (alternating current roughening).

The direct current roughening is the roughening electrochemically by providing direct current between the aluminum plate and a counter electrode in an aqueous solution containing nitric acid. Electric current may be supplied through electrolytic liquid or through a conductor roller, etc. A suitable nitric acid compound concentration of the nitric acid aqueous solution is from 100 g/l to saturation, preferably from 150 to 500 g/l. Preferable nitric acid compounds are aluminum nitrate, nitric acid, sodium nitrate, ammonium nitrate, magnesium nitrate, etc., and they may combined with other compounds containing nitrate ion. A preferable temperature of the nitric acid aqueous solution is from 30 to 55° C. The direct current voltage includes not only continuous direct current voltage but also commercial alternating current rectified by diode, transistor, thyristor, GTO or the like, rectangular pulse direct current, and is an electric voltage wherein polarity is not changed which meets general definition of direct current, and continuous direct current having a ripple factor of 10% or less is preferred. A preferable quantity of electricity charged on the aluminum plate is 10 to 250 C/dm$^2$, particularly preferably 10 to 100 C/dm$^2$.

The alternating current roughening is the roughening electrochemically by feeding alternating current between the aluminum plate and a counter electrode in an aqueous solution containing hydrochloric acid. Electric current may be supplied through electrolytic liquid or through a conductor roller, etc. A suitable hydrochloric acid compound concentration of the hydrochloric acid aqueous Solution is 1 g/l to saturation, preferably from 5 to 100 g/l. Preferable hydrochloric acid compounds are aluminum chloride, hydrochloric acid, sodium chloride, ammonium chloride, magnesium chloride, etc., and they may combined with other compounds containing hydrochloride ion. Moreover, it is preferable to add an aluminum salt and/or an ammonium salt in an amount from 20 to 150 g/l to the hydrochloric acid aqueous solution. A preferable temperature of the hydrochloric acid aqueous solution is from 30 to 55° C.

As the waveform of alternating current used for electrochemical roughening in the hydrochloric acid aqueous solution, there are sine waves as disclosed in Japanese Patent KOKOKU No. 48-28123, phase-controlled sine waves by a thyristor as disclosed in Japanese Patent KOKAI No. 55-25381, special waveforms as disclosed in Japanese Patent KOKAI No. 52-58602, and so on, and in view of equipment, rectangular wave alternating current at a duty ratio of 1:1 is preferable.

In the case of forming honeycomb pits having an average diameter from 0.5 to 2 μm in the second direct current or alternating current roughening, there are direct current roughening and alternating current roughening as above. The direct current roughening can be carried out according to the aforementioned method, except the quantity of electricity and current density. A suitable quantity of electricity charged on the aluminum plate used as anode is 10 to 250 $C/dm^2$, and a preferable current density is 10 to 200 $A/dm^2$. The alternating current roughening can be carried out according to the aforementioned method. The average diameter of the pits may be controlled by adjusting the concentration of the solution in which the roughening is carried out.

The third chemical etching is conducted for the purpose of removing smut components formed on the surface of the aluminum plate, and of improving brush scumming reduction and ground scumming reduction. As the acid used for the acidic aqueous solution, there are fluoric acid, fluorozirconic acid, phosphoric acid, sulfuric acid, hydrochloric acid, nitric acid and the like, and as the alkali used for the alkaline aqueous solution, there are sodium hydroxide, potassium hydroxide, trisodium phosphate, sodium aluminate, sodium silicate, sodium carbonate and the like. Two or more aforementioned acids or alkalis can be combined. As etching amount, it is preferable to etch from 0.01 to 2 $g/m^2$, and from 0.5 to 1.5 $g/m^2$ is more preferable.

In order to conduct etching of such an etching degree, it is suitable to select an acid or alkali concentration from 0.05 to 40%, a liquid temperature from 40 to 100° C. and a treating time from 5 to 300 seconds, The light etching can be conducted by an electrochemical treatment of the aluminum plate in an aqueous neutral salt solution by applying DC voltage wherein the aluminum plate is rendered a cathode.

On the surface of the aluminum plate after the light etching, insoluble matters, i.e. smuts, are generated. The smuts can be removed by washing with phosphoric acid, sulfuric acid, nitric acid, chromic acid or a mixture thereof.

After conducting the third chemical etching, honeycomb pits having an average diameter from 0.5 to 2 μm containing indentations of 0.1 μm or less, as described in Japanese Patent KOKAI 3-104694.

The anodizing is conducted for the purpose of improving hydrophilic ability, water retention, printing durability, etc., and conducted by immersing in an electrolytic solution containing sulfuric acid and/or phosphoric acid by applying DC voltage or AC voltage. After the anodizing, sealing may be conducted according to a conventional manner. The hydrophilic ability of the aluminum plate may be improved by immersing in an aqueous solution containing sodium silicate, etc. After the hydrophilic treatment, the aluminum plate may be further treated by immersing in an aqueous solution containing from 10 to 30 wt. % of sulfuric acid at from 50 to 80° C. for from 5 to 300 seconds.

The thickness of the anodized membrane is preferably from 0.5 to 10 $g/m^2$, more preferably 1 to 5 $g/m^2$, measure by the gravimetric method using Maison solution. It is preferable that the treatment rendering hydrophilic is conducted in an aqueous solution containing silicon to produce a hydrophilic membrane containing silicon.

A section profile of the aluminum plate was measured using a tracer type surface roughness tester having a contact finger of 1 μm in a half diameter, and two wavinesses were observed. One is the honeycomb pits formed in the first direct current roughening followed by dissolving in the second chemical ething, and the other is due to an average pitch between plateau portions formed in the first direct current roughening. That is, indentations having an average pitch from 1 to 80 μm are overlapped and coexist. Waviness having a pitch of less than 1 μm was also observed, which is the indentations of honeycomb pits formed in the electrochemical roughening at the second step.

When the aluminum plate was observed by a scanning electron microscope, it was found that the indentations having an average pitch from 1 to 80 μm and the honeycomb pits having an average diameter from 0.1 to 2 μm are overlapped. A suitable mean surface rougheness is from 0.3 to 1.5 μm, preferably from 0.4 to 1.0 μm.

A second aspect of the method of producing an aluminum support for a planographic printing plate of the invention (Production II) comprises, (1) etching a surface of an aluminum plate chemically in an acidic or alkaline aqueous solution (first chemical etching), (2) roughening the surface of the aluminum plate electrochemically in an acidic aqueous solution by applying DC voltage to form honeycomb pits having an average diameter from 0.5 to 7 μm with a density from 40,000 to 500,000 $pits/mm^2$ and to leave plateau portions without honeycomb pits or with honeycomb pits having an average diameter of less than 0.5 μm at a rate from 0 to 15% of the surface (first direct current roughening), (3) etching the surface of the aluminum plate chemically in an acidic or alkaline aqueous solution to render the plateau portions less than 10% of the surface (second chemical etching), and (4) anodizing or anodizing and rendering hydrophilic the surface of the aluminum plate in an acidic aqueous solution.

All of the above steps are similar to those of Production I.

A section profile of the aluminum plate was measured using a tracer type surface roughness tester having a contact finger from 1 μm in a half diameter, and two wavinesses ware observed. One is the honeycomb pits formed in the first direct current roughening followed by dissolving in the second chemical ething, and the other is due to an average pitch between plateau portions formed in the first direct current roughening. That is, indentations having an average pitch from 1 to 80 μm are overlapped and coexist. Waviness having a pitch of less than 1 μm was also observed, which may be noise. When the aluminum plate was observed by a scanning electron microscope, it was found that the honeycomb pits having an average diameter of 0.1 to 7 μm are formed. The mean surface roughness is 0.3 to 1.0 μm.

The roughening of an aluminum support made of an aluminum plate electrochemically in an acidic aqueous solution by applying DC voltage, comprises providing a soft starting zone at a first stage of the roughening the aluminum plate, and roughening the aluminum plate at a low current density in the soft starting zone (the soft starting zone is the part of the process where the first stage of roughening takes place, with the term "soft" referring to a low current density being used at this stage).

As a result of investigating eagerly, the inventors found that a very favorable surface shape can be obtained by treating the aluminum plate with a low current density at the first stage of the roughening.

The current density in the soft starting zone can be adjusted by utilizing spread of voltage in the electrolyte solution between an electrode and the aluminum web, or using an electric source for low current density electrolysis and electrode(s) independently, or a combination thereof. By controlling the current density in the soft starting zone, the surface shape of the aluminum plate can be varied.

The above method of utilizing spread of voltage in the electrolyte solution utilizes the phenomenon that the voltage applied between the aluminum plate and the electrolyte solution becomes lower approaching the entrance to the electrolytic bath, from an arbitrary point on the surface of the aluminum web facing the counter electrode along the aluminum web.

In the above method of using an electric source for low current density electrolysis and electrode(s), a low current density treatment is conducted by using the electric source for low current density electrolysis and the electrode(s), separate from the main electric source and electrode(s) used for electrolysis. In the former method utilizing spread of voltage in the electrolyte solution, when the thickness or width of the aluminum web varies, loaded impedance in the electrolytic bath varies. As a result, a voltage curve in the soft starting zone varies resulting in bringing a difference in a roughened shape. On the other hand, according to the latter method, the roughened shape does not vary, even if the thickness or width of the aluminum web change.

Because of obtaining a very favorable surface shape, it is preferable that an aluminum web is electrolyzed in an acidic electrolyte solution using three or more of electrolytic baths provided with at least one couple of an anode and a cathode and the same and/or a different soft starting zone at the entrance of an aluminum web. The electric source used for the main electrolysis in each electrolytic bath or each couple of an anode and a cathode is separated from the other electrolytic baths or the other electrodes, and an average current density is controlled at each electric bath or each couple of electrodes.

In view of controlling the surface shape, the soft starting zone is preferably provided at the entrance on the side where a cathode connected to a main electric source is arranged at the front. Moreover, the distance between the anode on the exit side and the liquid surface is preferably as short as possible.

The electrolysis time in the soft starting zone is preferably from 0.0001 to 5 seconds, more preferably from 0.0005 to 1 second, most preferably from 0.001 to 0.5 second. The current density in the soft starting zone may be increased gradually from zero or stepwisely by two or more steps. In the case of increasing gradually, the increasing form may be a straight line, an exponential line, a logarithmic line or the like. A preferable current density on the electrode(s) for low current density is 100 $A/dm^2$ or less, more preferably 50 $A/dm^2$ or less, most preferably 30 $A/dm^2$ or less and 1 $A/dm^2$ or more.

The soft starting zone may be provided in the main electrolytic bath or a separate bath. In the case of using a separate bath, it is preferable to use the same type of electrolysis solution, electrode(s), electric source and waveform as the main electrolytic bath in the viewpoint of equipment.

By providing the soft starting zone on the aluminum plate entrance side of the electrolytic bath at the part where anodic reaction of the aluminum plate occurs, surface conditions, such as formation of oxide membrane, of the aluminum plate is controlled in the soft starting zone, and thereby formation of honeycomb pits in the high current density (main) electrolysis zone is controlled. Of course a low current density zone corresponding to, the soft starting zone may be provided on the aluminum plate exit side of the electrolytic bath at the position where anodic reaction of the aluminum plate occurs. When the soft starting zone is provided on the aluminum plate entrance side or exit side at the part where cathodic reaction of the aluminum plate occurs, the formation of smut components mainly composed of aluminum hydroxide is varied resulting in controlling the pitting reaction in the subsequent anodic reaction of the aluminum plate. However, the effects are less than those obtained by providing the soft starting zone at the anodic reaction part of the aluminum plate.

When the aluminum plate previously treated in an acid or alkali aqueous solution is roughened electrochemically using direct current and when anodic reaction of the aluminum plate is conducted at first, continuous channel-shaped pits having a width from about 5 to 10 $\mu$m and a length of about 20 $\mu$m or more can be formed easily by roughening electrochemically using direct current at a traveling speed of the aluminum plate of 20 m/min or more. The aluminum plate, on which the channel-shaped pits are formed, does not satisfy the performances necessary for a printing plate. On the other hand, when the aluminum plate previously treated in an acid or alkali aqueous solution is roughened is started from cathodic reaction, continuous channel-shaped pits do not form.

In an advantageous embodiment, only anodes are arranged in the first electrolytic bath, and cathodic reaction of the aluminum plate is allowed to occur. In the second and the following electrolytic baths, cathode and anode are arranged alternately. The second and the following baths are preferably three or more cells, and each bath is preferably provided with one couple of cathode and anode or more. One or more electric sources can be connected to one electrolytic bath. It is preferable that the second and the following baths are provided with a cathode and the soft starting zone at the entrance of the bath. The second and the following baths are preferably provided with three or more couples of a cathode and an anode alternately, in view of forming honeycomb pits more uniformly on the surface of the aluminum plate. When the number of the couples is two or less, it is difficult to obtain uniform honeycomb pits by using a small quantity of electricity.

A preferable quantity of electricity used in the first electrolytic bath for the electrolysis of aluminum plate is from 10 to 200 $C/dm^2$, more preferably from 10 to 100 $C/dm^2$. A preferable current density is from 10 to 200 $A/dm^2$. Since the electrolytic conditions, such as quantity of electricity, current density and flow speed, at the first electrolytic bath influence the roughened shape at the second and the following electrolytic baths, an object roughened shape can be formed by optimizing electrolytic conditions at each electrolytic bath. The electrolytic conditions at the first electrolytic bath and the second and the following electrolytic baths may be identical with or different from each other. The optimal electrolytic conditions at each electrolytic bath can be determined by repeating experiments.

The roughening of an aluminum support as mentioned above can be applied to the first direct current roughening and second roughening. Particularly, it is preferably applied to the first direct current roughening because of forming a great waviness called big waves.

In Production I , Production II and the roughening of an aluminum support, structure of electrolytic bath, structure of electrode and liquid supply method may be known ones used for the surface treatment of an aluminum plate for a printing plate or electrolytic capacitor, general surface treatment of metal webs, such as iron and stainless steel. The electrolytic bath can be provided with one or more liquid inlet port(s) and exhaust port(s) at middle portions.

The form of electrolytic bath may be usual, such as vertical type, horizontal type, radial type, V-type, etc., and vertical type electrolytic baths are preferable in view of space saving and a space for mounting the soft starting zone. On the other hand, radial type electrolytic baths are superior in the handling of the aluminum plate web. In the case of vertical type electrolytic baths, it is preferable to provide each one or more liquid inlet port(s) and/or exhaust port(s) on baths in order to inhibit vibration of the aluminum plate by liquid flow. In the case of radial type electrolytic baths, liquid supply may be conventional.

As to the electric source used for the main electrolysis in each electrolytic bath, all electrolytic baths may be connected to one electric source. each electrolytic bath may be connected to a separate electric source independetly, or each couple of an anode and a cathode (which are arranged to a separate electrolytic bath, respectively) is connected to a separate electric source independently. By providing electric sources for each electric bath or each couple of an anode and a cathode independently, current density can be controlled at each electric bath or each couple of an anode and a cathode, and thereby, roughened shape can be controlled arbitrarily at each electrolytic bath or each couple of an anode and a cathode. It should be noted that when electric current is supplied from one electric source to a plurality of electrodes, impedance loaded on an aluminum plate varies by the thickness and width of the aluminum plate, the composition of electrolytic solution, liquid temperature and the like. Thereby, electric current varies at each electrode with the course of events, and production under constant conditions becomes difficult.

The aluminum plate applicable to the invention includes pure aluminum plates and aluminum alloy plates. Various aluminum alloys are usable, such as alloys of aluminum and a metal of silicon, copper, manganese, magnesium, chromium, lead, zinc, bismuth, titanium, tantalum, niobium, iron, nickel and combinations thereof.

The aluminum plate may be treated either only on one surface or both surfaces. In the case of treating one surface, either surface of the aluminum plate may be treated. When treating both surfaces, the treating may be conducted one surface by one surface successively or both surfaces simultaneously by providing electrodes on both sides of the aluminum plate. The photosensitive layer coated on the aluminum plate may be positive type or negative type.

The aluminum support for a planographic printing plate is superior in no clinging of ink and in brush scumming reduction.

According to the method of producing an aluminum support for a planographic printing plate of the invention, by producing the aluminum support having indentations with an average pitch from 1 to 80 $\mu$m and honeycomb pits having an average diameter from 0.1 to 2 $\mu$m formed on the surface and having a mean surface roughness of from 0.3 to 1.5 $\mu$m or by producing the aluminum support having indentations with an average from of 1 to 80 $\mu$m and honeycomb pits having an average diameter from 0.5 to 7 $\mu$m formed on the surface and having a mean surface roughness from 0.3 to 1.0 $\mu$m, surely, the aluminum support for a planographic printing plate produced is excellent in no clinging of ink and in brush scumming reduction.

According to the method of roughening an aluminum support of the invention, the generation of chattering marks (caused by uneven treatment in the direction vertical to the advancing direction of the aluminum plate) can be prevented by the soft starting zone. It is considered that conditions of oxide membrane produced at the initiation of anodic reaction of the aluminum plate vary by the soft starting zone, and thereby, pit producing reaction can be controlled. Moreover, by controlling the current density of the soft starting zone, pit shape can be controlled, and an optimal surface shape can be made irrespective of traveling speed of the aluminum plate.

Figure 2:
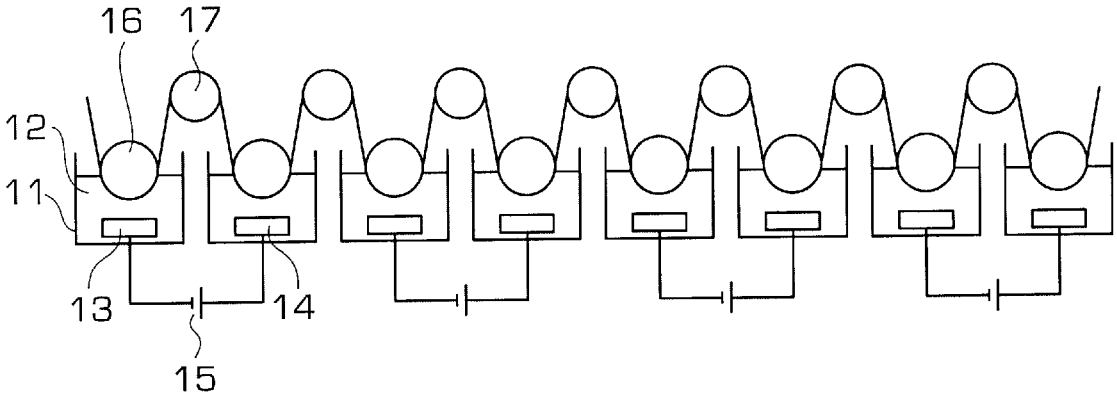

An apparatus used for the roughening using DC voltage in the method of producing an aluminum support for a planographic printing plate of the invention is illustrated in FIG. 1, and another apparatus used therefor is illustrated in FIG. 2.

In the roughening apparatus using DC voltage shown in FIG. 1, a plurality of electrolytic baths 1 are arranged in series. Each electrolytic bath 1 is filled with an acidic aqueous solution 2, and is provided with a cathode 3 and an anode 4 parallel to each other and both perpendicular to the bottom. The cathode 3 and the anode 4 are connected to a DC electric source 5. A partition wall 6 is interposed between the cathode 3 and the anode 4. A convey roller 7 is provided under the partition wall 6, and convey rollers 8 are also provided above the cathode 3 and the anode 4. The aluminum plate 9 travels between the cathode 3 and the partition wall 6 and between the anode 4 and the partition wall 6 almost in U-shape.

In the roughening apparatus using DC voltage shown in FIG. 2, a plurality of electrolytic baths 11 are arranged in series. Each electrolytic bath 1 is filled with an acidic aqueous solution 12, and is provided with a cathode 13 and an anode 14 alternately. The cathode 13 and the anode 14 are connected to a DC electric source 15. A convey roller 16 is provided in a state that the under half portion is immersed in the acidic aqueous solution 12, and convey rollers 17 are also provided above each electrolytic bath. The aluminum plate 18 travels through the convey rollers 16, 17.

Figure 3:
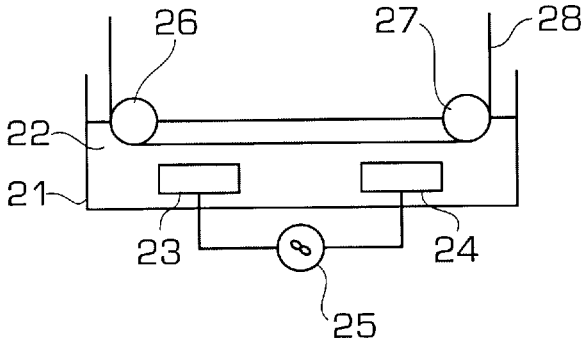
FIG. 3 is a schematic diagram illustrating apparatuses used for roughening by alternating current in the method of producing an aluminum support for a planographic printing plate of the invention.

An apparatus used for the roughening using AC voltage in the method of producing an aluminum support for a planographic printing plate of the invention is illustrated in FIG. 3.

In the roughening apparatus using AC voltage shown in FIG. 3, an electrolytic bath 21 is provided, and filled with an acidic aqueous solution 22. The electrolytic bath 21 is provided with a couple of electrodes 23, 24 which are connected to an AC electric source 25. A couple of convey roller 26, 27 are provided in a state that the under half portion is immersed in the acidic aqueous solution 22. The aluminum plate 28 travels through the convey rollers 26, 27.

Several roughening apparatuses using DC voltage for conducting the roughening of an aluminum support of the invention are illustrated in FIGS. 4–9.

Figure 4:
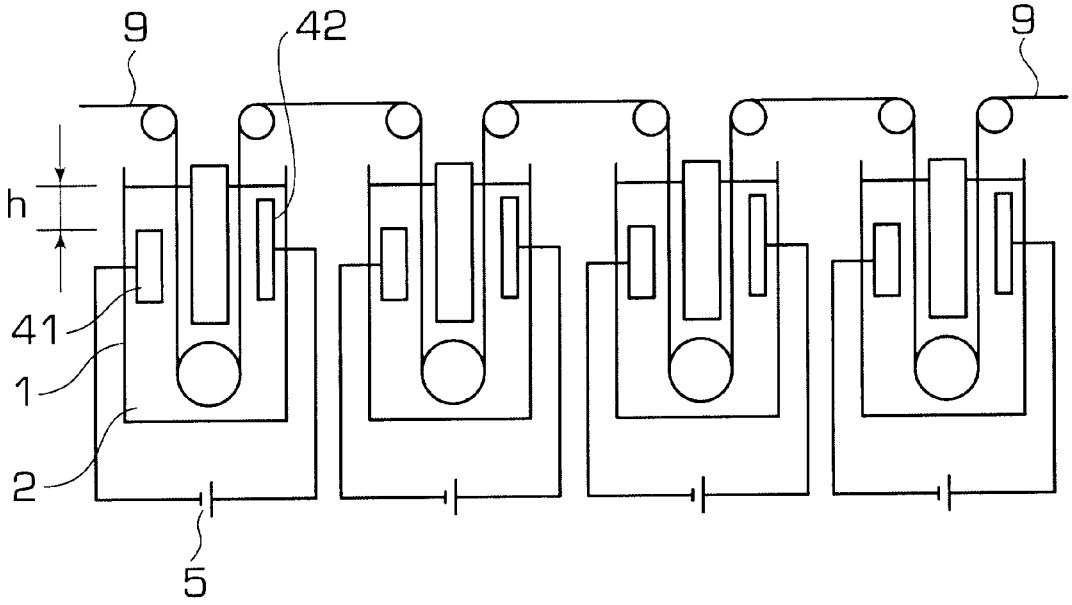
FIGS. 4 through 10 are schematic diagrams illustrating roughening apparatuses for conducting the method of roughening an aluminum support of the invention using d-c voltage.

In the roughening apparatus shown in FIG. 4, the upper end of the cathode 41 is lower or shorter than the anode 42 by the length h, and the other structure is the same as FIG. 1. Accordingly, in this apparatus, the aluminum plate 9 is at first, i.e. immediately after entering in the acidic aqueous solution 2, roughened by a low current density.

Figure 5:
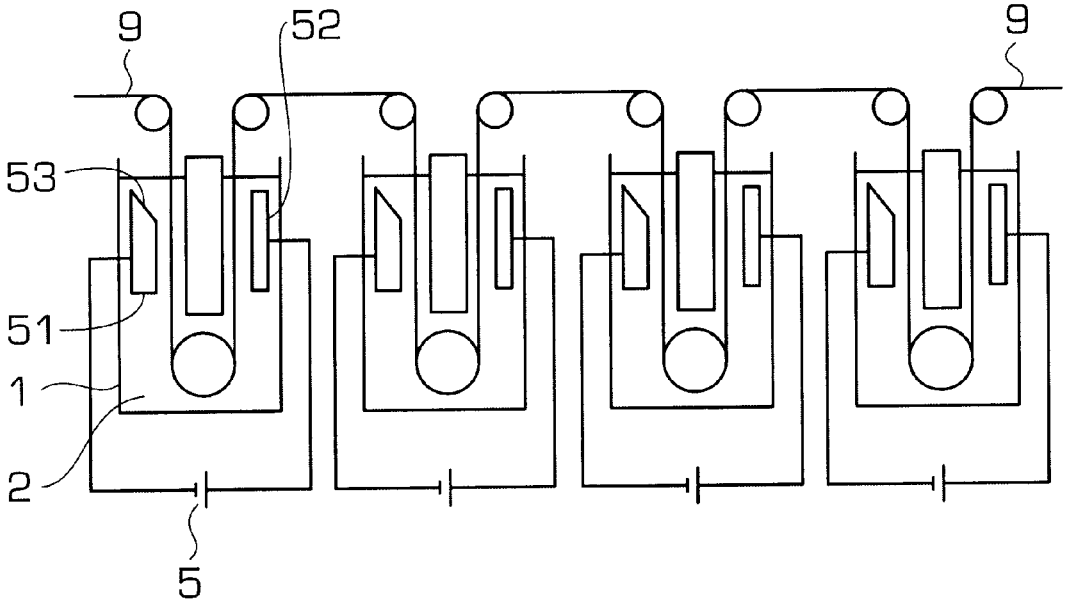

In the roughening apparatus shown in FIG. 5, the upper part of the cathode 51 is cut obliquely to form an oblique face 53 gradually apart from the anode 52 toward upside. The other structure is the same as FIG. 1. Accordingly, in this apparatus, the aluminum plate 9 is at first, i.e. immediately after entering in the acidic aqueous solution 2, roughened by a low current density by the oblique face 53.

Figure 6:
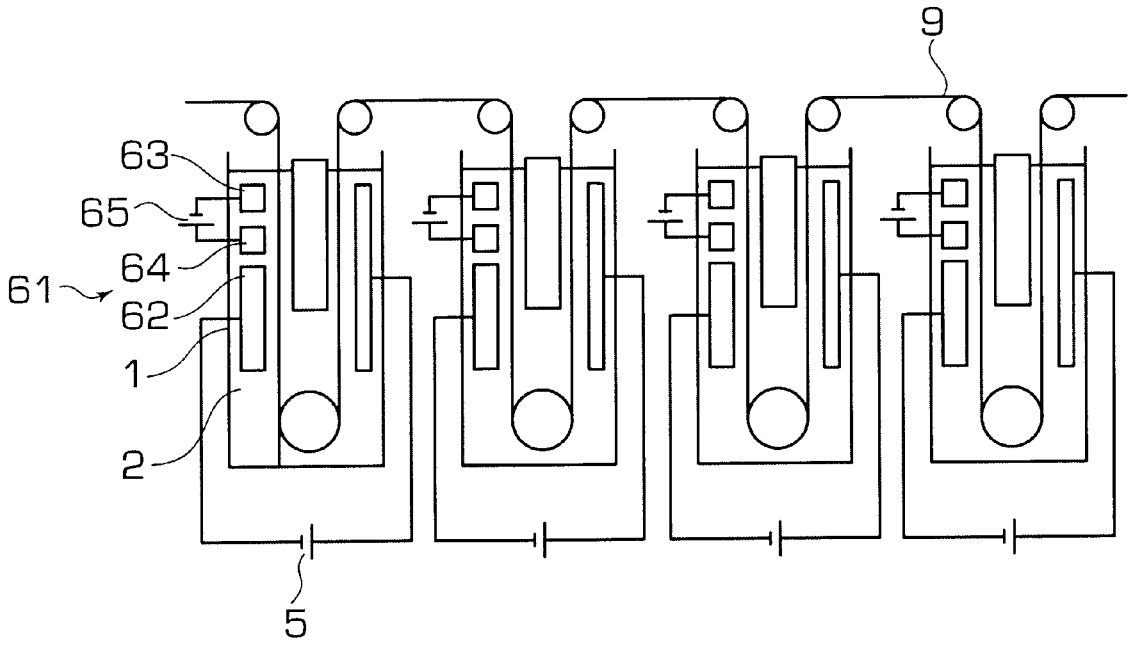

In the roughening apparatus shown in FIG. 6, the cathode 61 is composed of a cathode body 62 and a couple of cathode pieces 63, 64 for soft starting, and the cathode pieces 63, 64 are connected to a low voltage DC electric source 65. The other structure is the same as FIG. 1. Accordingly, in this apparatus, the aluminum plate 9 is at first, i.e. immediately after entering in the acidic aqueous solution 2, roughened by a low current density by the cathode pieces 63, 64 for soft starting.

Figure 7:
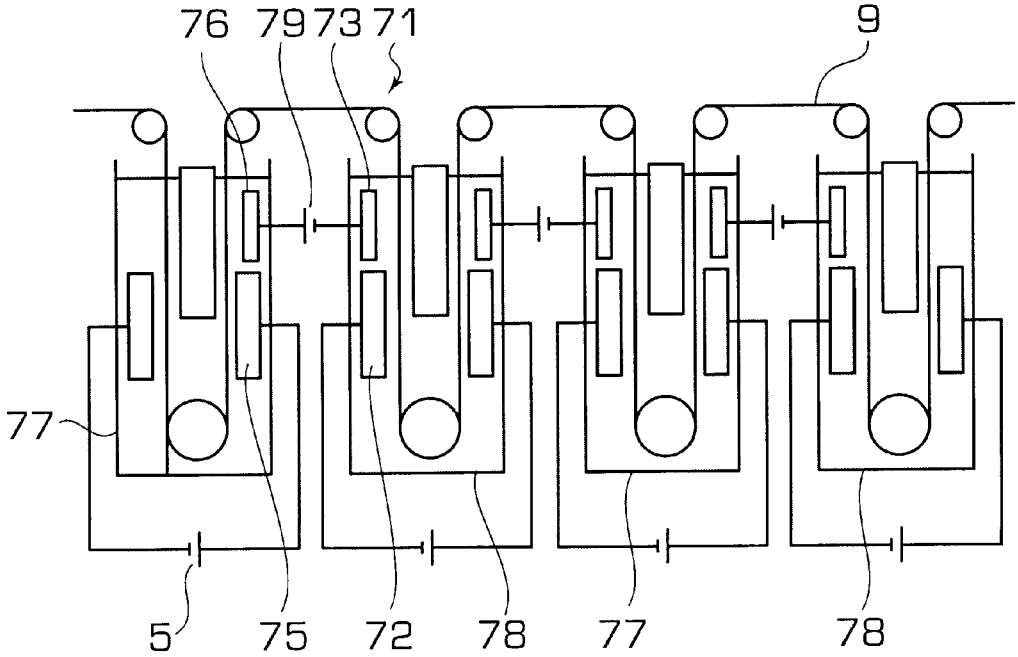

In the roughening apparatus shown in FIG. 7, the cathode 71 is composed of a main cathode 72 and a cathode 73 for soft starting, and the anode 74 is composed of a main anode 75 and an anode 76 for soft starting. The anode 76 for soft starting provided in an odd number electrolytic bath 77 counted from upstream side of traveling aluminum plate and the cathode 73 for soft starting provided in an even number electric bath 78 are connected to a low voltage DC electric source 79. The other structure is the same as FIG. 1. Accordingly, in this apparatus, the aluminum plate 9 is at first, i.e. immediately after entering in the acidic aqueous solution 2, roughened by a low current density by the cathode 73 for soft starting.

Figure 8:
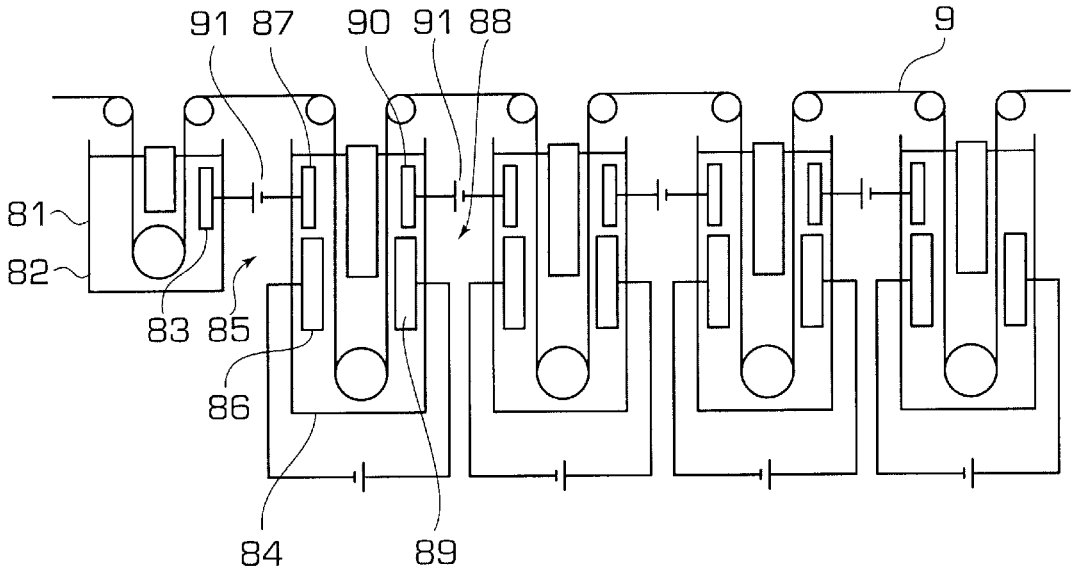

In the roughening apparatus shown in FIG. 8, an electrolytic bath 81 for soft starting is provided on the upstream side of the roughening apparatus. The electrolytic bath 81 for soft starting is filled with an acidic aqueous solution 82, and is provided with an anode 83 for soft starting. The cathode 85 of the electrolytic bath 84 for electrolytic roughening is composed of a main cathode 86 and a cathode 87 for soft starting, and the anode 88 is composed of a main anode 89 and an anode 90 for soft starting. The anode 83 for soft starting of the electrolytic bath 81 for soft starting and the cathode 87 for soft starting of the first electrolytic bath 84 for roughening are connected to a low voltage DC electric source 91, and thereafter, the anode 83 for soft starting of the electrolytic bath 84 for roughening and the cathode 87 for soft starting of the next electrolytic bath 84 are connected to a low-voltage DC electric source 91. The other structure is the same as FIG. 1. Accordingly, in this apparatus, the aluminum plate 9 is at first, i.e. immediately after entering in the acidic aqueous solution 2, roughened by a low current density by the cathode 87 for soft starting.

Figure 9:
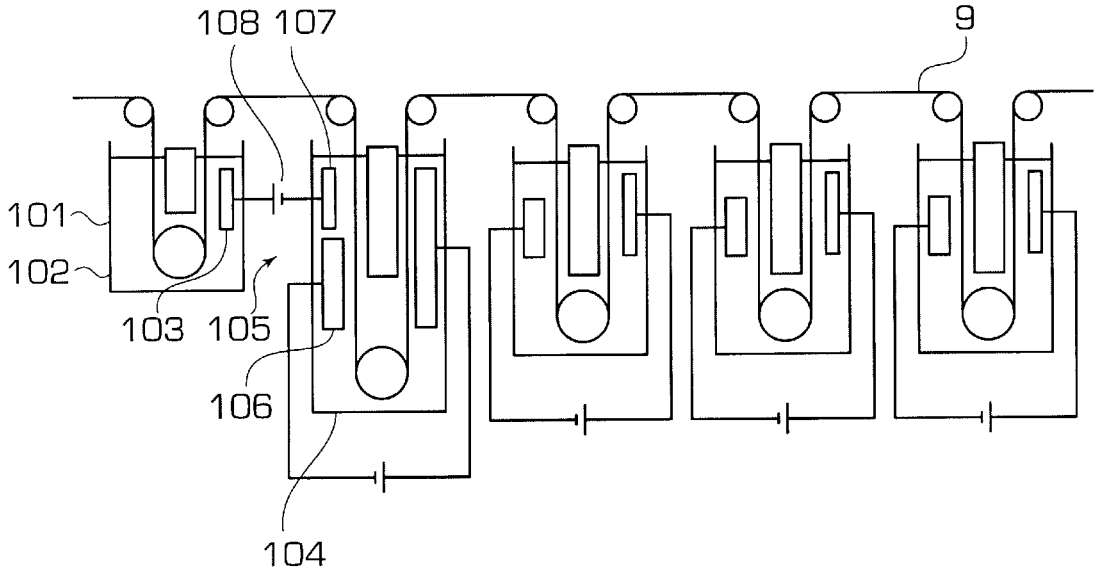
Figure 10:
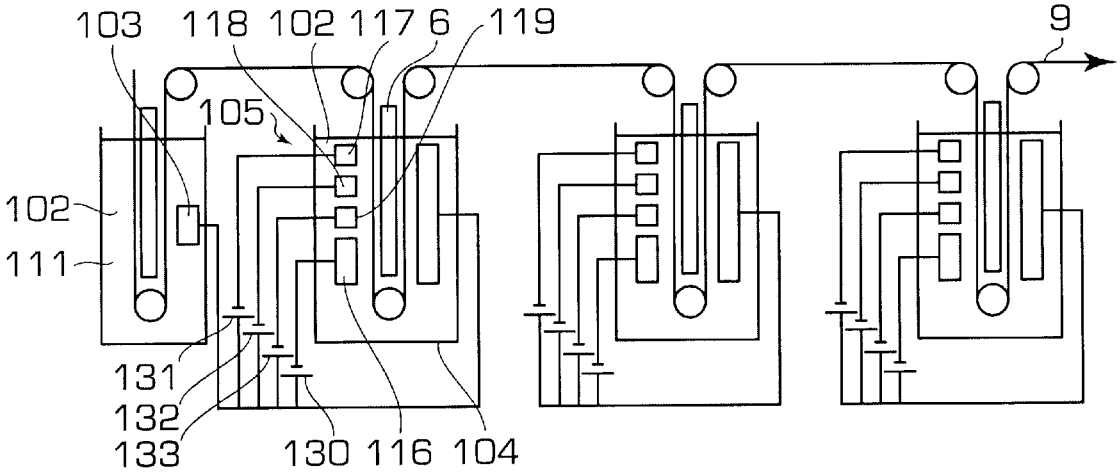

In the roughening apparatus shown in FIGS. 9 and 10, an electrolytic bath 101, 111 for soft starting is provided on the upstream of the roughening apparatus. The electrolytic bath 101, 111 for soft starting is filled with an acidic aqueous solution 102, and is provided with an anode 103 for soft starting. The cathode 105 of the first electrolytic bath 104 for electrolytic roughening is composed of a main cathode 106, 116 and a cathode(s) 107, 117–119 for soft starting. The anode 103 for soft starting of the electrolytic bath 101, 111 for soft starting and the cathode 107, 117–119 for soft starting of the first elecrolytic bath 104 for roughening are connected to a low voltage DC electic source(s) 108, 131–133. The other structure is the same as FIG. 1. Accordingly, in this apparatus, the aluminum plate 9 is at first, i.e. immediately after entering in the acidic aqueous solution 2, roughened by a low current density by the cathode 107, 117–119 for soft starting.

EXAMPLES

Example 1

A JIS 1050 aluminum plate 0.24 mm in thickness 300 mm in width was etched chemically by immersing in 5% sodium hydroxide aqueous solution at 60° C. for 20 seconds, and washed with water. Then, the aluminum plate was immersed in 1% nitric acid aqueous solution at 60° C. for 10 seconds, and washed with water.

Subsequently, the aluminum plate was electrochemically roughened using an apparatus shown in FIG. 1. The acidic aqueous solution was 1% nitric acid aqueous solution (containing 0.5% of aluminum ion and 70 ppm of ammonium ion) at 45° C. Anodes and cathodes were alternately arranged facing the aluminum plate, and continuous DC voltage was applied between each anode and cathode. The aluminum plate was passed with keeping a distance of 10 mm from these electrodes. The current density of DC voltage was 80 A/dm$^2$, the length of the anode and the cathode was 150 mm, respectively, and the traveling speed of the aluminium plate was 7.2 m/min.

By providing a dam made of a soft polyvinyl chloride, a soft starting zone was provided at the space between the liquid surface and the anode or cathode. Each length of the soft starting zone were as 20 mm, respectively. At the entrance portion and at the exit portion, the aluminum web was electrochemically treated at a current density lower than the stationary current density zone by the spread of electric potential from each electrode.

Thereafter, the aluminum plate was washed with water, and subsequently, immersed in 25% sulfuric acid aqueous solution at 60° C. for 60 seconds to remove smut components mainly composed of aluminum hydroxide, and then washed with water.

The surface of the aluminum plate was observed by a scanning electron microscope at a magnification of 750 times, and found that all honeycomb pits had an average diameter from 2 to 5 $\mu$m, and the density was 60,000 pits/mm$^2$. The area of plateau portions without honeycomb pit or with honeycomb pits having an average diameter of less than 0.5 $\mu$m was 25%.

The aluminum plate roughened by direct current was immersed in 25% sodium hydroxide aqueous solution (containing 5% of aluminum ion) at 60° C. for 10 seconds to etch 8.5 g/m$^2$ of the aluminum plate, and washed with water.

Then, the aluminum plate was immersed in 25% sulfuric acid aqueous solution at 60° C. for 10 seconds, and washed with water.

The surface of the aluminum plate was observed by a scanning electron microscope at a magnification of 750 times, and found that the plateau portions did not exist.

The aluminum plate was treated with the second stage electrochemical roughening by using 1% nitric acid aqueous solution (containing 0.5% of aluminum ion) at 45° C. as the electrolyte solution and supplying rectangular wave alternating current with a frequency of 60 Hz at a duty ratio of 1:1 between the aluminum plate and a counter electrode (made of carbon) for 14 seconds.

The aluminum plate roughened by alternating current was washed with water, and chemically etched by immersing in 5% sodium hydroxide aqueous solution (containing 0.5% of aluminum ion) at 35° C. for 20 seconds to remove 1.0 g/m$^2$ of the aluminum plate, and washed with water. Then, the aluminum plate was immersed in 25% sulfuric acid aqueous solution at 60° C. for 10 seconds, and washed with water.

The surface of the aluminum plate was observed by a scanning electron microscope, it was found that there were big waviness, and honeycomb pits having an average diameter of 1 $\mu$m was formed uniformly on the big waviness. The mean surface roughness of the aluminum plate was 0.6 $\mu$m.

According to a conventional manner, a positive type printing plate was prepared by anodizing the aluminum plate in an aqueous solution containing sulfuric acid as the principal component using direct current, washing with water, drying, coating a positive type lightsensitive layer, and then drying. The printing plate was excellent in brush scumming reduction, printing durability, tone reproducibility, removal of ink, fill-in reduction of ink at half-tone dot portions upon reducing damping water, etc.

Example 2

A JIS 1050 aluminum plate 0.24 mm in thickness was etched chemically by immersing in 5% sodium hydroxide aqueous solution at 60° C. for 20 seconds, and washed with water. Then, the aluminum plate was immersed in 1% nitric acid aqueous solution at 60° C. for 10 seconds, and washed with water.

Subsequently, the aluminum plate was electrochemically roughened using an apparatus shown in FIG. 1. The acidic aqueous solution was 1% nitric acid aqueous solution (containing 0.5% of aluminum ion and 70 ppm of ammonium ion) at 45° C. Anodes and cathodes were alternately arranged facing the aluminum plate, and DC voltage was loaded between each anode and cathode. The aluminum plate was applied with keeping a distance of 10 mm from these electrodes. The current density was 80 A/dm$^2$, the length of the anode and the cathode was 150 mm, respectively, and the traveling speed of the aluminium plate was 7.2 m/min.

By providing a partition wall made of a soft polyvinyl chloride, a soft starting zone was provided at the space between the liquid surface and the anode or cathode. The length of the soft starting zone was 150 mm at the entrance of the first bath, 20 mm at the exit of the first bath, and the entrance and exit of the second to fourth baths, respectively. At the entrance portion and at the exit portion of the bath the aluminum plate web was electrochemically treated at a current density lower than the stationary current density zone by the spread of electric potential from each electrode but the length of the soft starting zone was different between the first bath and the other baths.

Thereafter, the aluminum plate was washed with water, and subsequently, immersed in 25% sulfuric acid aqueous solution at 60° C. for 60 seconds to remove smut components mainly composed of aluminum hydroxide, and then washed with water.

The surface of the aluminum plate was observed by a scanning electron microscope at a magnification of 750 times, and found that all honeycomb pits had an average diameter the 4 to 6 $\mu$m, and the density was 45,000 pits/mm$^2$. The area of plateau portions without honeycomb pit or with honeycomb pits having an average diameter of less than 0.5 $\mu$m was 40%.

The aluminum plate roughened by direct current was immersed in 25% sodium hydroxide aqueous solution (containing 5% of aluminum ion) at 60° C. for 15 seconds to etch 8.5 g/m$^2$ of the aluminum plate, and washed with water. Then, the aluminum plate was immersed in 25% sulfuric acid aqueous solution at 60° C. for 10 seconds, and washed with water.

The surface of the aluminum plate was observed by a scanning electron microscope at a magnification of 750 times, and found that the plateau portions did not exist.

The aluminum plate was treated with the second stage electrochemical roughening by using 1% nitric acid aqueous solution (containing 0.5% of aluminum ion) at 45° C. as the electrolyte solution and applying rectangular wave alternating current with a frequency of 60 Hz at a duty ratio of 1:1 between the aluminum plate and a counter electrode (made of carbon) for 14 seconds.

The aluminum plate roughened by alternating current was washed with water, and chemically etched by immersing in 5% sodium hydroxide aqueous solution (containing 0.5% of aluminum ion) at 35° C. for 20 seconds to remove 1.0 g/m$^2$ of the aluminum plate, and washed with water. Then, the aluminum plate was immersed in 25% sulfuric acid aqueous solution at 60° C. for 10 seconds, and washed with water.

The surface of the aluminum plate was observed by a scanning electron microscope, it was found that there were big waviness, and honeycomb pits having an average diameter of 1 $\mu$m was formed uniformly on the big waviness. The mean surface roughness of the aluminum plate was 0.7 $\mu$m.

According to a conventional manner, a positive type printing plate was prepared by anodizing the aluminum plate in an aqueous solution containing sulfuric acid as the principal component using direct current, washing with water, drying, coating a positive type lightsensitive layer, and then drying. The printing plate was excellent in brush scumming reduction, printing durability, tone reproducibility, removal of ink, fill-in reduction of ink at half-tone dot portions upon reducing damping water, etc. Particularly, the fill-in reduction of ink at half-tone dot portions upon reducing damping water is further excellent than Example 1, and the support is suitable for high class printing capable building up of ink.

Example 3

A JIS 1050 aluminum plate 0.24 mm in thickness was etched chemically by immersing in 5% sodium hydroxide aqueous solution at 60° C. for 20 seconds, and washed with water. Then, the aluminum plate was immersed in 1% nitric acid aqueous solution at 60° C. for 10 seconds, and washed with water.

Subsequently, the aluminum plate was electrochemically roughened using an apparatus shown in FIG. 2. The acidic aqueous solution was 1% nitric acid aqueous solution (containing 0.5% of aluminum ion and 70 ppm of ammonium ion) at 45° C. Anodes and cathodes were alternately arranged facing the aluminum plate, and DC voltage was applied between each anode and cathode. The aluminum plate was passed with keeping a distance of 10 mm from these electrodes. The current density was 200 A/dm$^2$, the length of the anode and the cathode was 20 mm, respectively, and the traveling speed of the aluminium plate was 2.4 m/min.

The distance from the liquid surface to each cathode or anode along the aluminum plate was 20 mm, respectively.

Thereafter, the aluminum plate was washed with water, and subsequently, immersed in 25% sulfuric acid aqueous solution at 60° C. for 60 seconds to remove smut components mainly composed of aluminum hydroxide, and then washed with water.

Figure 11:
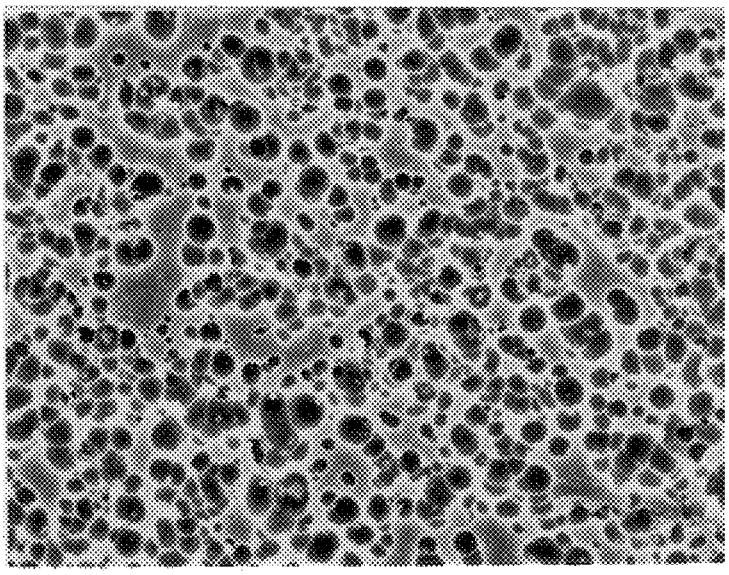
FIG. 11 is an electron microscope photograph showing a state of the surface after a firt direct current roughening and removal of smuts in the method of producing an aluminum support for a planographic printing plate of the invention.

The surface of the aluminum plate was observed by a scanning electron microscope at a magnification of 750 times, and found that honeycomb pits having an average diameter from 1 to 10 $\mu$m were widely distributed, and the density was 70,000 pits/mm$^2$. An electron microscope photograph of the aluminum plate surface is shown in FIG. 11. The area of plateau portions without honeycomb pit or with honeycomb pits having an average diameter of less than 0.5 $\mu$m was 30%.

The aluminum plate roughened by direct current was immersed in 25% sodium hydroxide aqueous solution (containing 5% of aluminum ion) at 60° C. for 10 seconds to etch 5.5 g/m$^2$ of the aluminum plate, and washed with water. Then, the aluminum plate was immersed in 25% sulfuric acid aqueous solution at 60° C. for 10 seconds, and washed with water.

The surface of the aluminum plate was observed by a scanning electron microscope at a magnification of 750 times, and found that the plateau portions did not exist.

Figure 12:
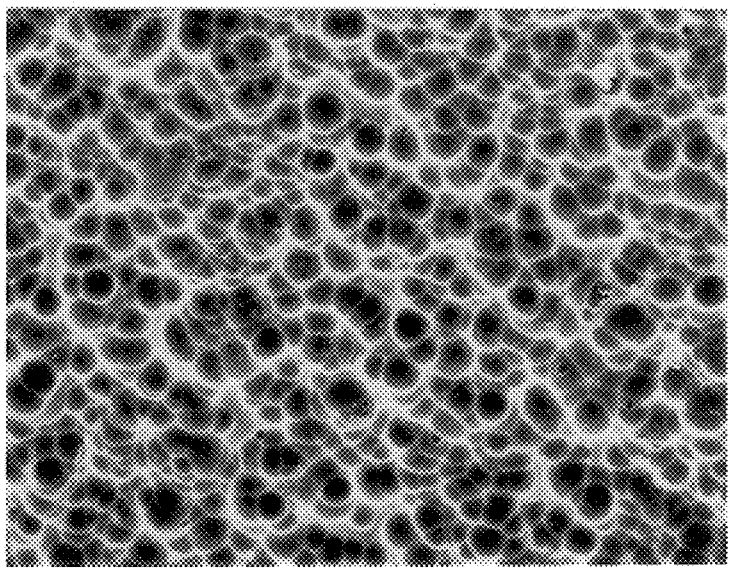
FIG. 12 is an electron microscope photograph showing a state of the surface after a first direct current roughening, removal of smuts and etching in the method of producing an aluminum support for a planographic printing plate of the invention.

An electron microscope photograph of the aluminum plate surface is shown in FIG. 12.

The aluminum plate was treated with the second stage electrochemical roughening by using 1% nitric acid aqueous solution (containing 0.5% of aluminum ion) at 45° C. as the electrolyte solution and supplying rectangular wave alternating current with a frequency of 60 Hz at a duty ratio of 1:1 between the aluminum plate and a counter electrode (made of carbon) for 14 seconds.

The aluminum plate roughened by alternating current was washed with water, and chemically etched by immersing in 5% sodium hydroxide aqueous solution (containing 0.5% of aluminum ion) at 35° C. for 20 seconds to remove 1.0 g/m$^2$ of the aluminum plate, and washed with water. Then, the aluminum plate was immersed in 25% sulfuric acid aqueous solution at 60° C. for 10 seconds, and washed with water.

The surface of the aluminum plate was observed by a scanning electron microscope, it was found that there were big waviness, and honeycomb pits having an average diameter of 1 $\mu$m was formed uniformly on the big waviness. The mean surface roughness of the aluminum plate was 0.60 $\mu$m.

Figure 13:
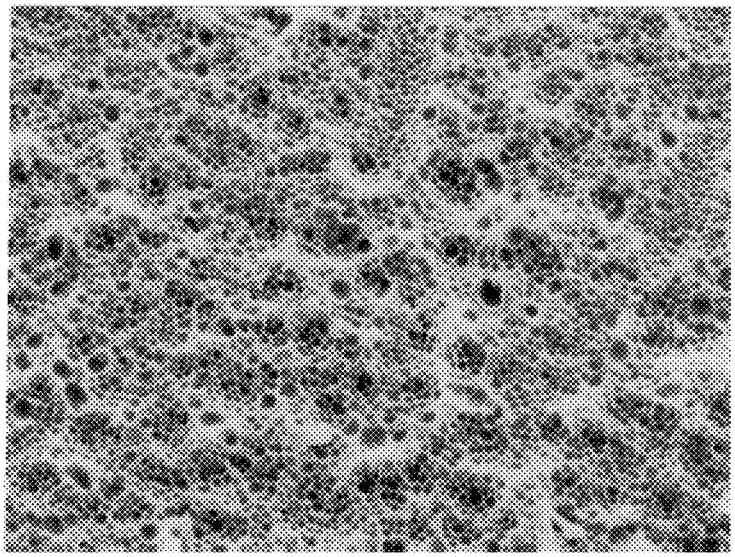
FIG. 13 is an electron microscope photograph showing a state of the surface after a first direct current roughening, removal of smuts, etching, a second alternating current roughening and etching in the method of producing an aluminum support for a planographic printing plate of the invention.

An electron microscope photograph of the aluminum plate surface is shown in FIG. 13.

According to a conventional manner, a positive type printing plate was prepared by anodizing the aluminum plate in an aqueous solution containing sulfuric acid as the principal component using direct current, washing with water, drying, coating a positive type lightsensitive layer, and then drying. The printing plate was excellent in brush scumming reduction, printing durability, tone reproducibility, removal of ink, fill-in reduction of ink at half-tone dot portions upon reducing damping water, etc.

Example 4

A JIS 1050 aluminum plate 0.24 mm in thickness was etched chemically by immersing in 5% sodium hydroxide aqueous solution at 60° C. for 20 seconds, and washed with water. Then, the aluminum plate was immersed in 1% nitric acid aqueous solution at 60° C. for 10 seconds, and washed with water.

Subsequently, the aluminum plate was electrochemically roughened using an apparatus shown in FIG. 2. The acidic aqueous solution was 1% nitric acid aqueous solution (containing 0.5% of aluminum ion and 70 ppm of ammonium ion) at 45° C. Anodes and cathodes were alternately arranged facing the aluminum plate, and DC voltage was applied between each anode and cathode. The aluminum plate was passed with keeping a distance of 10 mm from these electrodes. The current density was 125 A/dm$^2$, the length of the anode and the cathode was 20 mm, respectively, and the traveling speed of the aluminium plate was 1.2 m/min.

The distance from the liquid surface to each cathode or anode along the aluminum plate was 20 mm, respectively.

Thereafter, the aluminum plate was washed with water, and subsequently, immersed in 25% sulfuric acid aqueous solution at 60° C. for 60 seconds to remove smut components mainly composed of aluminum hydroxide, and then washed with water.

The surface of the aluminum plate was observed by a scanning electron microscope at a magnification of 750 times, and found that all honeycomb pits had an average diameter of from 2 to 10 $\mu$m and the density was 24,000 pits/mm$^2$. The area of plateau portions without honeycomb pit or with honeycomb pits having an average diameter of less than 0.5 $\mu$m was 50%.

The aluminum plate roughened by direct current was immersed in 25% sodium hydroxide aqueous solution (containing 5% of aluminum ion) at 60° C. for 30 seconds to etch 15 g/m$^2$ of the aluminum plate, and washed with water. Then, the aluminum plate was immersed in 25% sulfuric acid aqueous solution at 60° C. for 10 seconds, and washed with water.

The surface of the aluminum plate was observed by a scanning electron microscope at a magnification of 750 times, and found that about 5% of plateau portions remained.

The aluminum plate was treated with the second stage electrochemical roughening by using 1% nitric acid aqueous solution (containing 0.5% of aluminum ion) at 45° C. as the electrolyte solution and supplying rectangular wave alternating current with a frequency of 60 Hz at a duty ratio of 1:1 between the aluminum plate and a counter electrode (made of carbon) for 14 seconds.

The aluminum plate roughened by alternating current was washed with water, and chemically etched by immersing in 5% sodium hydroxide aqueous solution (containing 0.5% of aluminum ion) at 35° C. for 20 seconds to remove 1.0 g/m$^2$ of the aluminum plate, and washed with water. Then, the aluminum plate was immersed in 25% sulfuric acid aqueous solution at 60° C. for 10 seconds, and washed with water.

The surface of the aluminum plate was observed by a scanning electron microscope, it was found that there were big waviness, and honeycomb pits having an average diameter of 1 $\mu$m was formed uniformly on the big waviness. The mean surface roughness of the aluminum plate was 0.8 $\mu$m.

According to a conventional manner, a positive type printing plate was prepared by anodizing the aluminum plate in an aqueous solution containing sulfuric acid as the principal component using direct current, washing with water, drying, coating a positive type lightsensitive layer, and then drying. The printing plate was excellent in brush scumming reduction, printing durability, tone reproducibility, removal of ink, fill-in reduction of ink at half-tone dot portions upon reducing damping water, etc.

Example 5

A JIS 1050 aluminum plate 0.24 mm in thickness was etched chemically by immersing in 5% sodium hydroxide aqueous solution at 60° C. for 20 seconds, and washed with water. Then, the aluminum plate was immersed in 1% nitric acid aqueous solution at 60° C. for 10 seconds, and washed with water.

Subsequently, the aluminum plate was electrochemically roughened using an apparatus shown in FIG. 2. The acidic aqueous solution was 1% nitric acid aqueous solution (containing 0.5% of aluminum ion and 70 ppm of ammonium ion) at 45° C. Anodes and cathodes were alternately arranged facing the aluminum plate, and continuous DC voltage was applied between each anode and cathode. The aluminum plate was passed with keeping a distance of 10 mm from these electrodes. The current density was 200

A/dm$^2$, the length of the anode and the cathode was 20 mm, respectively, and the traveling speed of the aluminium plate was 2.4 m/min.

The distance from the liquid surface to each cathode or anode along the aluminum plate was 20 mm, respectively.

Thereafter, the aluminum plate was washed with water, and subsequently, immersed in 25% sulfuric acid aqueous solution at 60° C. for 60 seconds to remove smut components mainly composed of aluminum hydroxide, and then washed with water.

The surface of the aluminum plate was observed by a scanning electron microscope at a magnification of 750 times, and found that honeycomb pits having an average diameter from 1 to 10 μm were widely distributed, and the density was 70,000 pits/mm$^2$. The area of plateau portions without honeycomb pit or with honeycomb pits having an average diameter of less than 0.5 μm was 30%.

The aluminum plate roughened by direct current was immersed in 25% sodium hydroxide aqueous solution (containing 5% of aluminum ion) at 60° C. for 10 seconds to etch 5.5 g/m$^2$ of the aluminum plate, and washed with water.

Then, the aluminum plate was immersed in 25% sulfuric acid aqueous solution at 60° C. for 10 seconds, and washed with water.

The surface of the aluminum plate was observed by a scanning electron microscope at a magnification of 750 times, and found that the plateau portions did not exist.

The aluminum plate was treated with the second stage electrochemical roughening by using 34% nitric acid aqueous solution (containing 0.5% of aluminum ion) at 45° C. as the electrolyte solution and supplying direct current rendering the aluminum plate as the anode and a counter electrode (made of carbon) at a current density of 20 A/dm$^2$ for 3 seconds.

The aluminum plate roughened by alternating current was washed with water, and chemically etched by immersing in 5% sodium hydroxide aqueous solution (containing 0.5% of aluminum ion) at 35° C. for 20 seconds to remove 0.1 g/m$^2$ of the aluminum plate, and washed with water. Then, the aluminum plate was immersed in 25% sulfuric acid aqueous solution at 60° C. for 10 seconds, and washed with water.

The surface of the aluminum plate was observed by a scanning electron microscope, it was found that there were big waviness, and honeycomb pits having an average diameter of 0.3 μm was formed uniformly on the big waviness. The mean surface roughness of the aluminum plate was 0.6 μm.

According to a conventional manner, a positive type printing plate was prepared by anodizing the aluminum plate in an aqueous solution containing sulfuric acid as the principal component using direct current, washing with water, drying, coating a positive type lightsensitive layer, and then drying. The printing plate was excellent in brush scumming reduction, printing durability, tone reproducibility, removal of ink, fill-in reduction of ink at half-tone dot portions upon reducing damping water, etc.

Observed Results

As to the aluminum plates provided with up to the anodizing or the treatment rendering hydrophilic in Examples 1–5, a section profile of each aluminum plate was measured using a tracer type surface roughness tester having a contact finger 1 μm in a half diameter, and two wavinesses ware observed. One is the honeycomb pits formed in the first roughening followed by dissolving in the second chemical ething, and the other is due to an average pitch between plateau portions formed in the first direct current roughening. That is, a big waviness of about 2 to 80 μm pitch was observed. Concretely, indentations having an average pitch from 2 to 80 μm are overlapped and coexist.

The waviness having a pitch of less than 2 μm was also observed, which is the indentations of honeycomb pits formed in the electrochemical roughening at the second step. When the surface was observed by a scanning electron microscope, it was found that the honeycomb pits having an average diameter from 0.1 to 2 μm were formed. A suitable mean surface roughness is from 0.3 to 1.5 μm, preferably from 0.4 to 1.0 μm.

The depth of the big waviness from 2 to 80 μm pitch was determined by the section profile, and the depth was from about 0.1 to 4 μm. The surface was observed by a scanning electron microscope, honeycomb pits having an average diameter from 0.1 to 2 μm were found formed in the electrochemical roughening at the second step. The density of the honeycomb pits having an average deameter from of 0.1 to 2 μm was from 100,000 to 100,000,000 pits/mm$^2$.

The depth of the honeycomb pits having an average diameter from 0.5 to 2 μm formed in the electrochemical roughening at the second step was determined by a section photograph, and found to be from about 0.1 to 0.5 μm.

The surface of the aluminum plates treated by the electrochemical roughening at the first step and the subsequent chemical etching in Examples 1–5 was observed by a scanning electron microscope at a magnification of 750 times, and found boul-shaped indentations having an average diameter from 2 to 15 μm at a density from about 8,000 to 100,000 indentations/mm$^2$.

Example 6

The hydrophilic ability of the aluminum plate after anodized in Example 1 was improved by immersing in 2% sodium silicate aqueous solution for 10 seconds, and then washed with water.

According to a conventional manner, a positive type printing plate was prepared by coating a negative type lightsensitive layer, and then drying. The printing plate was excellent in brush scumming reduction, printing durability, tone reproducibility, removal of ink, fill-in reduction of ink at half-tone dot portions upon reducing damping water, etc.

Example 7

A JIS 1050 aluminum plate 0.24 mm in thickness was etched chemically by immersing in 5% sodium hydroxide aqueous solution at 60° C. for 20 seconds, and washed with water. Then, the aluminum plate was immersed in 1% nitric acid aqueous solution at 60° C. for 10 seconds, and washed with water.

Subsequently, the aluminum plate was electrochemically roughened using an apparatus shown in FIG. 1. The acidic aqueous solution was 1% nitric acid aqueous solution (containing 0.5% of aluminum ion and 70 ppm of ammonium ion) at 45° C. Anodes and cathodes were alternately arranged facing the aluminum plate, and DC voltage was applied between each anode and cathode. The aluminum plate was passed with keeping a distance of 10 mm from these electrodes. The current density was 80 A/dm$^2$, the length of the anode and the cathode was 150 mm, respectively, and the traveling speed of the aluminium plate was 7.2 m/min.

By providing a partition wall made of a soft polyvinyl chloride, the distance from the liquid surface to the anode or cathode was made 20 mm, respectively.

Thereafter, the aluminum plate was washed with water, and subsequently, immersed in 25% sulfuric acid aqueous solution at 60° C. for 60 seconds to remove smut components mainly composed of aluminum hydroxide, and then washed with water.

The surface of the aluminum plate was observed by a scanning electron microscope at a magnification of 750 times, and found that all honeycomb pits had an average diameter from 1 to 3 μm, and the density was 250,000 pits/mm$^2$. The area of plateau portions without honeycomb pit or with honeycomb pits having an average diameter of less than 0.5 μm was about 5% or less.

The aluminum plate roughened by direct current was immersed in 25% sodium hydroxide aqueous solution (containing 5% of aluminum ion) at 60° C. for 10 seconds to etch 2.5 g/m$^2$ of the aluminum plate, and washed with water. Then, the aluminum plate was immersed in 25% sulfuric acid aqueous solution at 60° C. for 10 seconds, and washed with water.

The surface of the aluminum plate was observed by a scanning electron microscope at a magnification of 750 times, and found that the plateau portions did not exist. The mean surface roughness of the aluminum plate was 0.5 μm.

According to a conventional manner, a positive type printing plate was prepared by anodizing the aluminum plate in an aqueous solution containing sulfuric acid as the principal component using direct current, washing with water, drying, coating a positive type lightsensitive layer, and then drying. The printing plate was excellent in brush scumming reduction, printing durability, tone reproducibility, removal of ink, fill-in reduction of ink at half-tone dot portions upon reducing damping water, etc.

Example 8

A JIS 1050 aluminum plate 0.24 mm in thickness was etched chemically by immersing in 5% sodium hydroxide aqueous solution at 60° C. for 20 seconds, and washed with water. Then, the aluminum plate was immersed in 1% nitric acid aqueous solution at 60° C. for 10 seconds, and washed with water.

Subsequently, the aluminum plate was electrochemically roughened using an apparatus shown in FIG. 1. The acidic aqueous solution was 1% nitric acid aqueous solution (containing 0.5% of aluminum ion and 70 ppm of ammonium ion) at 45° C. Anodes and cathodes were alternately arranged facing the aluminum plate, and DC voltage was applied between each anode and cathode. The aluminum plate was passed with keeping a distance of 10 mm from these electrodes. The current density was 80 A/dm$^2$, the length of the anode and the cathode was 150 mm, respectively, and the traveling speed of the aluminium plate was 7.2 m/min.

By providing a partition wall made of a soft polyvinyl chloride, the distance from the liquid surface to the anode or cathode was made 20 mm, respectively.

Thereafter, the aluminum plate was washed with water, and subsequently, immersed in 25% sulfuric acid aqueous solution at 60° C. for 60 seconds to remove smut components mainly composed of aluminum hydroxide, and then washed with water.

The surface of the aluminum plate was observed by a scanning electron microscope at a magnification of 750 times, and found that all honeycomb pits had an average diameter from 5 to 7 μm, and the density was 40,000 pits/mm$^2$. The area of plateau portions without honeycomb pit or with honeycomb pits having an average diameter of less than 0.5 μm was about 15%.

The aluminum plate roughened by direct current was immersed in 25% sodium hydroxide aqueous solution (containing 5% of aluminum ion) at 60° C. for 10 seconds to etch 2.5 g/m$^2$ of the aluminum plate, and washed with water. Then, the aluminum plate was immersed in 25% sulfuric acid aqueous solution at 60° C. for 10 seconds, and washed with water.

The mean surface roughness of the aluminum plate was 0.6 μm.

According to a conventional manner, a positive type printing plate was prepared by anodizing the aluminum plate in an aqueous solution containing sulfuric acid as the principal component using direct current, washing with water, drying, coating a positive type lightsensitive layer, and then drying. The printing plate was excellent in brush scumming reduction, printing durability, tone reproducibility, removal of ink, fill-in reduction of ink at half-tone dot portions upon reducing damping water, etc.

Example 9

The same aluminum plate was treated by the same method as Example 7, except changing the current density to 125 A/dm$^2$, the length of the electrodes to 150 mm, the length of the soft starting zone to 10 mm, and the traveling speed of the aluminum plate to 7.2 m/min.

The surface of the aluminum plate was observed by a scanning electron microscope at a magnification of 750 times, and found the honeycomb pits having an average diameter from 1 to 2 μm were formed uniformly over the whole surface.

Example 10

In Example 1, current density of each electrolytic bath was arbitrarily varied in the direct current roughening at the first step.

The results are shown in Table 1

TABLE 1

| | Current Density (A/dm$^2$) | | | | Quantity of | Mean Surface |
|---|---|---|---|---|---|---|
| Ex. No | 1st Bath | 2nd Bath | 3rd Bath | 4th Bath | Electricity (C/dm$^2$) | Roughness (μm) |
| Ex. 10-1 | 80 | 80 | 80 | 80 | 400 | 0.6 |
| Ex. 10-2 | 95 | 75 | 75 | 75 | 400 | 0.65 |
| Ex. 10-3 | 65 | 85 | 85 | 85 | 400 | 0.7 |

As shown in Table 1, surface shape of the aluminum plate can be controlled by varying current density at respective electrolytic baths.

Comparative Example 1

The same aluminum plate was roughened by the same electrochemical roughening using direct current at the first step as Example 2. 2.5 g/m$^2$ of the aluminum plate was etched by immersing in 25% sodium hydroxide aqueous solution (containing 5% of aluminum ion) at 60° C. for 10 seconds, and washed with water. Then, the aluminum plate was immersed in 25% sulfuric acid aqueous solution at 60° C. for 10 seconds, and washed with water.

The surface of the aluminum plate was observed by a scanning electron microscope at a magnification of 750 times, and found that the plateau portions was about 15%.

The aluminum plate was further treated with the electrochemical roughening at the second step and thereafter treatments of Example 2.

The surface of the aluminum plate was observed by a scanning electron microscope, it was found that there were big waviness, and honeycomb pits having an average diameter of 1 μm was formed uniformly on the big waviness. The mean surface roughness of the aluminum plate was 0.65 μm.

According to a conventional manner, a positive type printing plate was prepared by anodizing the aluminum plate in an aqueous solution containing sulfuric acid as the principal component using direct current, washing with water, drying, coating a positive type lightsensitive layer, and then drying. The printing plate was inferior in brush scumming reduction, compared with Example 2.

The results were compared with Examples 1–5 and summarized in Table 2.

The aluminum plate roughened by alternating current was washed with water, and chemically etched by immersing in 5% sodium hydroxide aqueous solution (containing 0.5% of aluminum ion) at 35° C. for 20 seconds to remove 1.0 g/m$^2$ of the aluminum plate, and washed with water. Then, the aluminum plate was immersed in 25% sulfuric acid aqueous solution at 60° C. for 10 seconds, and washed with water.

The surface of the aluminum plate was observed by a scanning electron microscope, it was found that there were big waviness, and honeycomb pits having an average diameter of 1 μm was formed uniformly on the big waviness. The mean surface roughness of the aluminum plate was 0.55 μm.

According to a conventional manner, a positive type printing plate was prepared by anodizing the aluminum plate in an aqueous solution containing sulfuric acid as the principal component using direct current, washing with water, drying, coating a positive type lightsensitive layer, and then drying. The printing plate was inferior in brush scumming reduction, compared with Examples. Moreover, flatness of the aluminum plate was also inferior compared with Examples.

TABLE 2

| | First DC Roughening | | | | Second DC or AC Roughning | | Mean Surface Roughness | Printability | |
|---|---|---|---|---|---|---|---|---|---|
| No. | Average Pit Diameter (μm) | Plateau Portion (%) | Average Pit Diameter of 0.5–10 μm (pits/mm$^3$) | Plateau Portion after Etching (%) | Supplied Electricity | Average Pit Diameter (μm) | after Anodizing (μm) | Brush Scumming Reduction | Fill-in Reduction of Ink |
| Ex. 1 | 2-5 | 25 | 60,000 | 0 | A C | 1 | 0.6 | A | A |
| Ex. 2 | 4-6 | 40 | 45,000 | 5 | A C | 1 | 0.65 | A | A |
| Ex. 3 | 1-10 | 30 | 70,000 | 0 | A C | 1 | 0.6 | A | A |
| Ex. 4 | 2-10 | 50 | 24,000 | 0 | A C | 1 | 0.8 | A | A |
| Ex. 5 | 1-10 | 30 | 70,000 | 0 | D C | 0.3 | 0.6 | A | A |
| C. Ex. 1 | 4–6 | 40 | 45,000 | 15 | A C | 1 | 0.65 | B–C | A |

A: Excellent
B: Good
C: Passable

Comparative Example 2

A surface of a metal roll was roughened by using a nylon brush and a suspension of pumice. A JIS 1050 aluminum plate 0.3 mm in thickness was roughened by pressing of the roughened metal roller.

The surface of the aluminum plate was observed by a scanning election microscope at a magnification of 750 times, and found that honeycomb pits did not exist, and the surface was in a shape of a field cultivated by a hoe.

The aluminum plate was immersed in 25% sodium hydroxide aqueous solution (containing 5% of aluminum ion) at 60° C. for 10 seconds to etch 5.5 g/m$^2$ of the aluminum plate, and washed with water. Then, the aluminum plate was immersed in 25% sulfuric acid aqueous solution at 60° C. for 10 seconds, and washed with water.

The surface of the aluminum plate was observed by a scanning electron microscope at a magnification of 750 times, and found that the surface had a big waviness similar to Examples. However, in the case of Examples, indentations were bowl-shaped uniform ones, but in Comparative Example 2, a lot of crevice-shaped long recessions exist together with bowl-shaped indentations.

The aluminum plate was treated with the second stage electrochemical roughening by using 1% nitric acid aqueous solution (containing 0.5% of aluminum ion) at 45° C. as the electrolyte solution and supplying rectangular wave alternating current with a frequency of 60 Hz at a duty ratio of 1:1 between the aluminum plate and a counter electrode (made of carbon) for 14 seconds.

Comparative Example 3

The same aluminum plates was treated by the same method as Example 1 except not conducting the soft starting. As a result, wave-formed baring, which might be caused by variation of liquid surface level, was formed on the surface of the aluminum plate.

We claim:

1. A method of producing an aluminum support for a planographic printing plate which comprises, (1) etching a surface of an aluminum plate chemically in an acidic or alkaline aqueous solution, (2) roughening the surface of the aluminum plate electrochemically in an acidic aqueous solution by applying DC voltage to form honeycomb pits having an average diameter from 0.5 to 10 μm with a density of 10,000 to 100,000 pits/mm$^2$ and to leave plateau portions without honeycomb pits or with honeycomb pits having an average diameter of less than 0.5 μm at a rate from 15 to 60% of the surface, (3) etching the surface of the aluminum plate chemically in an acidic or alkaline aqueous solution to render the plateau portions less than 10% of the surface, (4) roughening the surface of the aluminum plate electrochemically in an acidic aqueous solution using direct current or alternating current to form honeycomb pits having an average diameter from 0.1 to 2 μm, (5) etching the surface of the aluminum plate chemically in an acidic or alkaline aqueous solution, and (6) anodizing or anodizing and rendering hydrophilic the surface of the aluminum plate in an acidic aqueous solution.

2. The method of producing an aluminum support of claim 1, wherein said aluminum plate has indentations having an average pitch of from 1 to 80 μm and a mean surface roughness of from 0.3 to 1.5 μm.

3. A method of producing an aluminum support for a planographic printing plate which comprises, (1) etching a surface of an aluminum plate chemically in an acidic or alkaline aqueous solution;

(2) roughening the surface of the aluminum plate electrochemically in an acidic aqueous solution by applying DC voltage, which comprises (a) providing at a first roughening stage, a soft starting zone by roughening the aluminum plate at a current density of 100 A/dm$^2$ or less, which is lower than the current density used in any subsequent main roughening step, for a period of 0.0001 to 5 seconds, and (b) carrying out a main roughening step, wherein the DC voltage for the roughening is provided by at least one electrode in the soft starting zone connected to a first electric power supply for electrolysis at 100 A/dm$^2$ or less, and by at least one additional electrode connected to a separate main electric source for electrolysis in said main roughening step, the roughening forming honeycomb pits having an average diameter from 0.5 to 7 μm with a density from 40,000 to 500,000 pits/mm$^2$ and leaving plateau portions without honeycomb pits or with honeycomb pits having an average diameter of less than 0.5 μm at a rate from 0 to 15% of the surface;

(3) if the plateau portions are 10% or more of the surface, etching the surface of the aluminum plate chemically in an acidic or alkaline aqueous solution to render the plateau portions less than 10% of the surface; and (4) anodizing or anodizing and rendering hydrophilic the surface of the aluminum plate in an acidic aqueous solution.

4. The method of producing an aluminum support of claim 3, wherein said aluminum plate has indentations having an average pitch of from 1 to 80 μm and a mean surface roughness of from 0.3 to 1.0 μm.

* * * * *